US005269438A

United States Patent [19]

Kelsey

[11] Patent Number: 5,269,438

[45] Date of Patent: Dec. 14, 1993

[54] CONTAINER FOR LIQUIDS

[75] Inventor: Steven F. Kelsey, Ealing, England

[73] Assignee: Crown Berger Europe Limited, Darwen, United Kingdom

[21] Appl. No.: 775,992

[22] PCT Filed: Mar. 20, 1990

[86] PCT No.: PCT/GB90/00421

§ 371 Date: Nov. 19, 1991

§ 102(e) Date: Nov. 19, 1991

[87] PCT Pub. No.: WO90/11228

PCT Pub. Date: Oct. 4, 1990

[30] Foreign Application Priority Data

Mar. 21, 1989 [GB] United Kingdom ..... 8906418

[51] Int. Cl.[5] ..... B65D 25/28

[52] U.S. Cl. ..... 220/766; 220/377; 220/761; 220/768; 220/773; 220/254; 220/695; 220/696; 215/16; 215/100 A; 222/465.1; 222/566; 222/567

[58] Field of Search ..... 215/100 A, 1 C; 220/94 R, 94 A, 377, 761, 766, 768, 773, 254, 377, 695, 696; 294/31.2; 222/465.1, 566, 567

[56] References Cited

U.S. PATENT DOCUMENTS

| | | | |
|---|---|---|---|
| 1,304,415 | 5/1919 | Tucker | 220/696 X |
| 2,120,487 | 6/1938 | Conner | 220/94 R |
| 2,189,955 | 2/1940 | Hokerk | 220/377 X |
| 2,740,655 | 4/1956 | Maly | 294/31.2 |
| 3,308,997 | 3/1967 | Kelly | 220/94 A |
| 3,310,088 | 3/1967 | Hildebrandt et al. | 220/94 A |
| 3,367,491 | 2/1968 | Dunham et al. | 220/377 X |
| 3,387,749 | 6/1968 | Godshalk et al. | 220/94 A |
| 4,125,210 | 11/1978 | Embree | 220/254 X |
| 4,169,537 | 10/1979 | Sabreen et al. | 220/606 |
| 4,474,303 | 10/1984 | Maccise | 220/94 A |
| 4,893,723 | 1/1990 | Seabolt | 220/695 X |

FOREIGN PATENT DOCUMENTS

| | | |
|---|---|---|
| 5839280 | 11/1981 | Australia . |
| 1187603 | 9/1959 | France . |
| 2314104 | 1/1977 | France . |
| 528486 | 10/1940 | United Kingdom . |

*Primary Examiner*—Allan N. Shoap
*Assistant Examiner*—Paul A. Schwarz
*Attorney, Agent, or Firm*—William R. Hinds

[57] ABSTRACT

An open topped container (1) for liquids such as paint, which container is provided with a pivotally mounted carrying handle(5), wherein the handle is pivotally mounted substantially off-center with respect to the container body (2), whereby when a user holds the container suspended by the handle (5), at least a major part of the open top of the container (1) is unobstructed by the presence of the handle (5) and the user's hand. A wide pouring channel (9) is provided located so that any paint left on the channel (9) after pouring drains back into the container (1) as the container (1) is subsequently held by the handle (5) in readiness for painting.

4 Claims, 3 Drawing Sheets

CONTAINER FOR LIQUIDS

This invention relates to containers for surface coating materials, such as paint.

The invention is concerned with the problem of making handled paint containers, for example, more practical in use.

According to the present invention there is provided a container for surface coating materials comprising an open-topped container body and provided with a pivotally mounted carrying handle at the open top mounted substantially off-center with respect to the container body so that when a user holds the container suspended by the handle at least % major part of the open top of the container is unobstructed by the presence of the handle and the user's hand, wherein the container has at least one pair of opposite sides which are straight and mutually parallel and the handle extends between said sides, characterised in that the container body is made of plastics material and comprises a thin-walled lower container body part provided around its open top with a separately formed plastics shroud part which externally forms an upward continuation and termination of the container body wall and internally defines an opening to receive a circular lid for the container in plug fashion, and further characterised in that the handle is pivoted in the shroud part in a position and manner so that when the container is suspended by the handle it tips so as to increase the said major unobstructed part.

In a preferred form of the invention the container has the shroud part defining a pouring channel which is uppermost on the container body when the container tips when suspended by the handle. The shroud part may define a recess to accommodate the handle entirely within the confines of the shroud.

The lower body part may be transparent or translucent, to render the contents visible, while the shroud on the other hand is pigmented to serve an identification function.

The invention will now be described further with reference to the accompanying drawings, in which.

Figure 1:
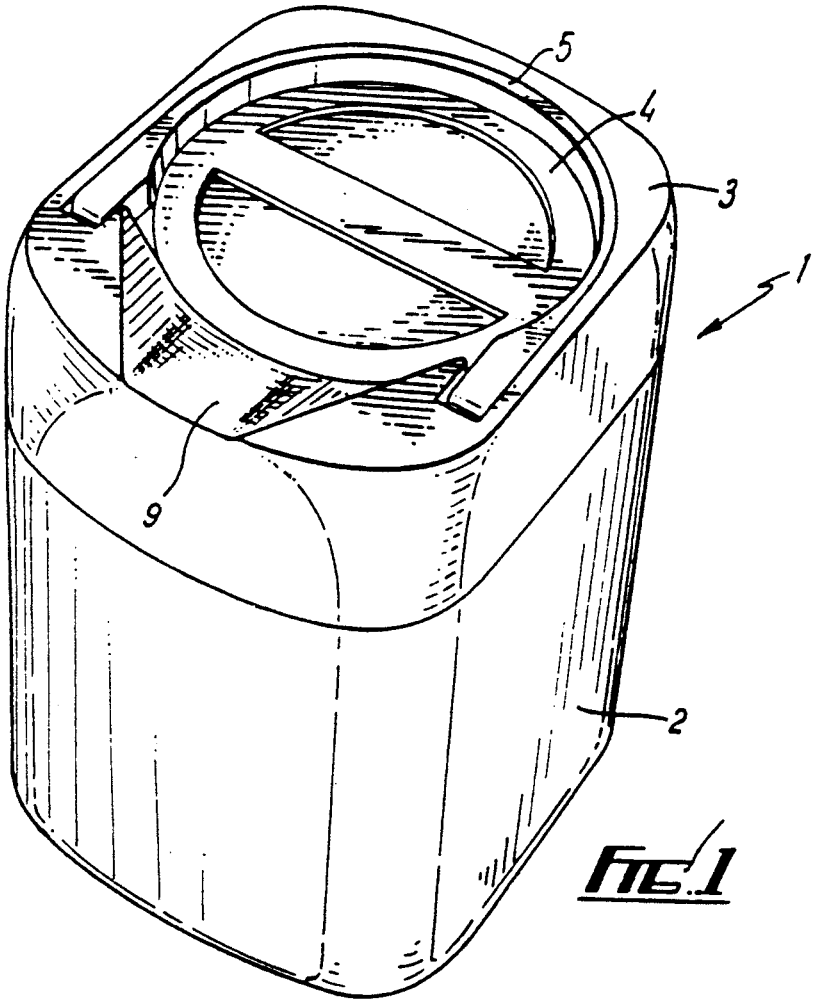
FIG. 1 is a perspective view of a plastics container according to the invention.
Figure 2:
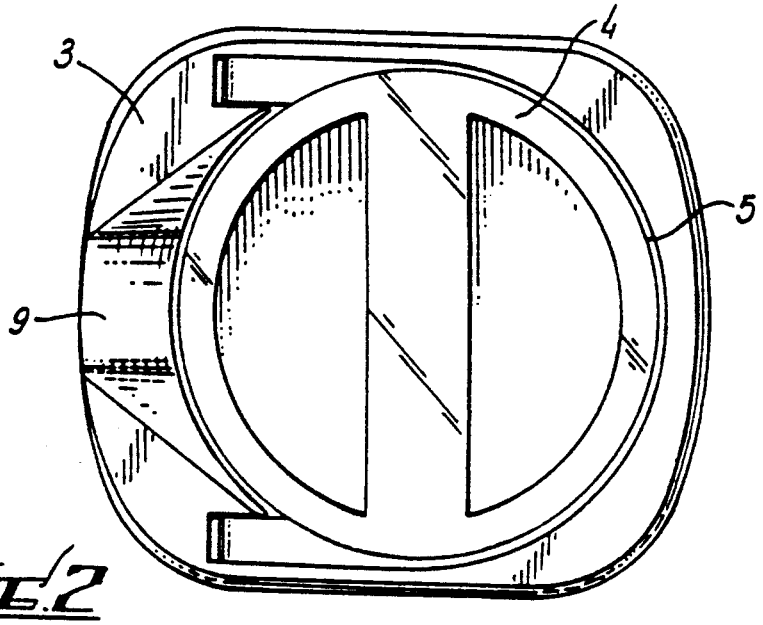
FIG. 2 is a plan view of the container.

A plastics paint container 1 according to the invention has a body 2 which is made from PET plastics material. The body 2 is generally rectangular, in horizontal section, with rounded corners; this configuration provides for comparatively wide and flat display areas on the container side walls, a wide pouring channel, and well spaced pivots for the container handle. The square shape lends itself to correct and uniform orientation of the containers when they are stacked or placed in rows at the point of sale. The upper part of the container comprises a separately formed plastics shroud 3, firmly secured to the body 2. The outside surface of the shroud is flush with the outside surface of the container body so that the shroud forms a smooth upward continuation of the body, whilst internally the shroud defines a circular opening to receive a plug-like lid 4 for the container. A carrying handle 5 of the container is pivotally mounted to the shroud.

Figure 3:
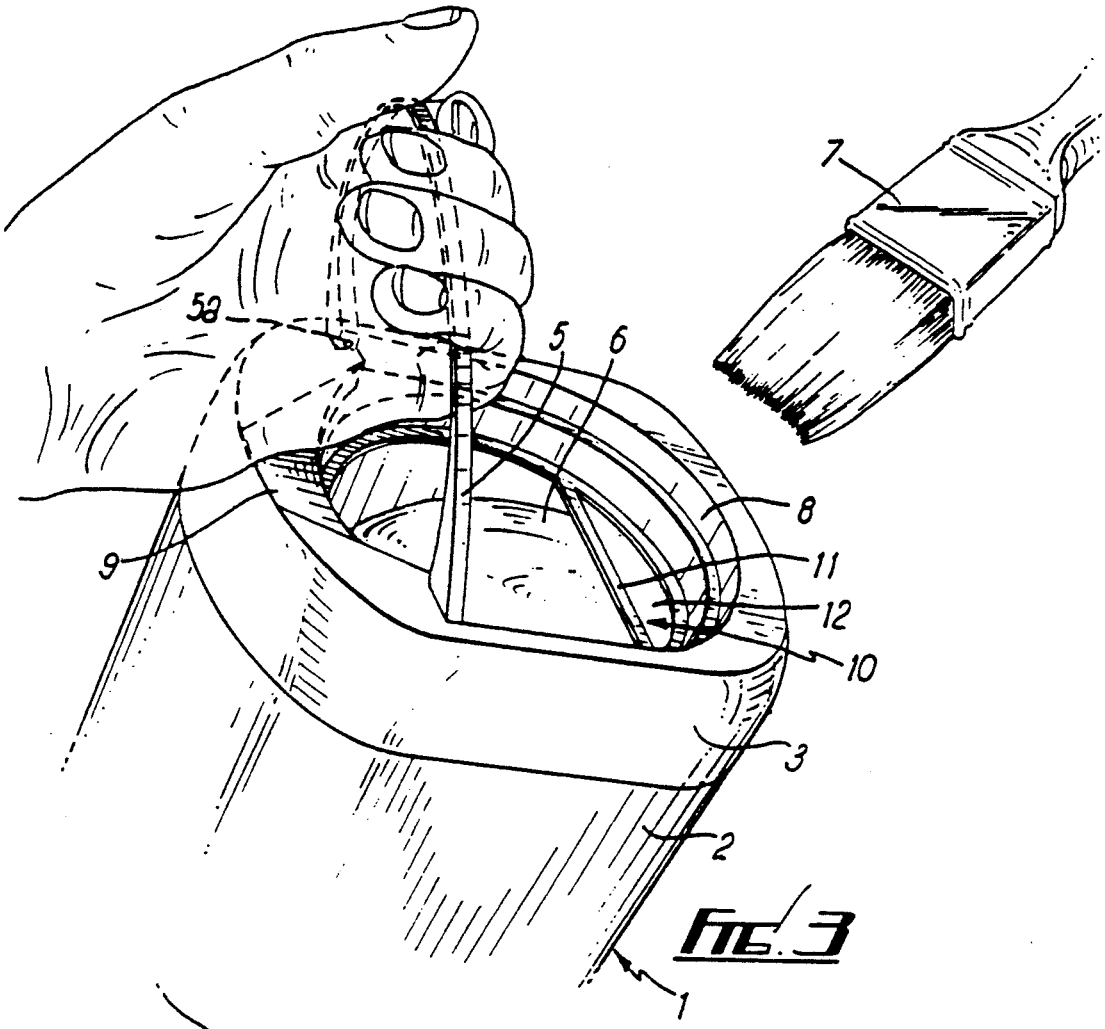
FIG. 3 is a perspective view showing the container in use, with its lid removed.
Figure 4:
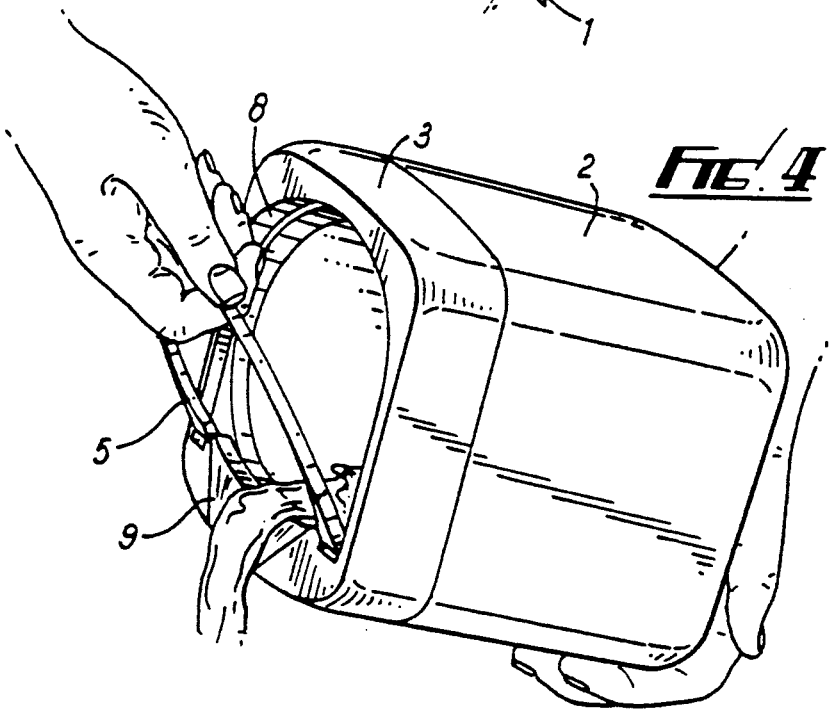
FIG. 4 is another view of the container in use for pouring.

The handle 5 is mounted displaced laterally relative to the vertical center plane of the container at pivots 5*a*, so that when the container is in use, suspended from the handle, as seen in FIG. 3, the container hangs in a position tipped away from the handle and the user's hand, typically at about 15° to the vertical, with the result that the surface of the paint in the container is open to access by a brush 7 to a substantially greater degree that it would be if the handle had been centrally mounted.

The shroud is formed with a recess 8 to receive the handle when the latter is not in use, so that the handle is stowed entirely within the surface of the shroud, thus facilitating stacking and storage of the container.

The shroud is formed with a pouring channel 9 on the same side of the vertical center plane as the handle, so that the pouring channel is on the opposite side from that towards which the container tips when suspended by its handle and the channel 9 becomes uppermost on the container body (FIG. 3). This also gives drainage back into the container when used after pouring.

A brush wiping member 10 (FIG. 3) is incorporated in the shroud. The member comprises an inner, chord-like bar 11 whose edge defines a linear brush wiping surface, and a sector-like body portion 12 by way of which is it mounted to the shroud. In a preferred modification the member 10 is shaped so that a straight central part of the bar 11 is elevated above the ends of the bar and the arcuate boundary of the body portion 12.

Figure 5:
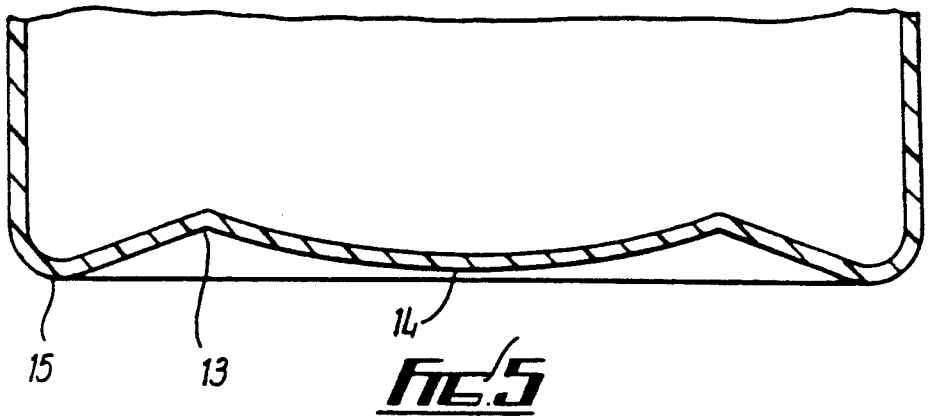
FIG. 5 is a partial cross-sectional view of the base of the container.

Referring to FIG. 5, a recess 13 is provided around the base of the container body, to facilitate handling but the central area 14 of the base projects downwardly to substantially the same plane as the edges 15, so as to provide a central surface on which the container can rest if it is stacked on top of another such container in an off-center position.

Figure 6:
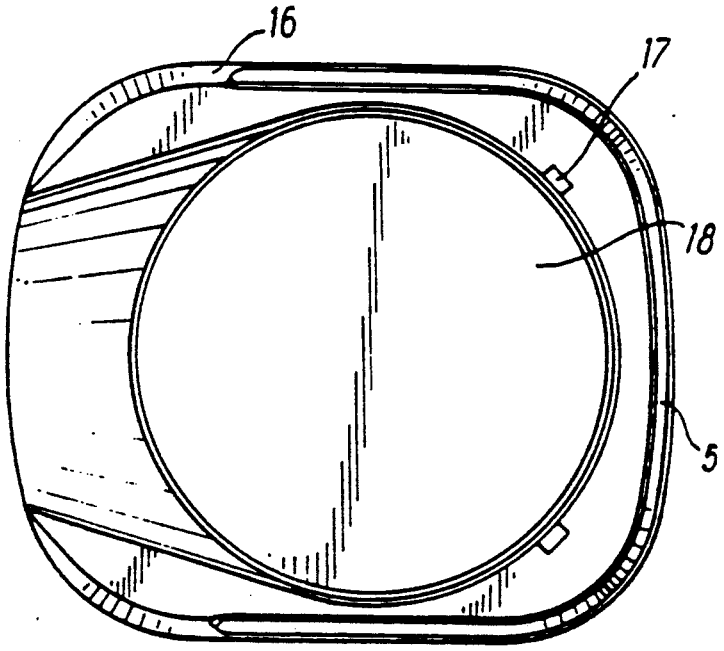
FIG. 6 is a plan view of a modified embodiment.

FIG. 6 shows a modification in which the handle 5, when in its stowed position, is received in a recess 16 defined in the upper side of the shroud, rather than in its top surface. Slots 17 are provided around the lid opening, for the insertion of a tool such as a screw-driver to lever out the lid 18, which in this embodiment is provided with an outwardly directed rim for this purpose. In the embodiment of FIGS. 1 to 5 the lid has an inwardly directed rim to enable it to be removed manually by the user.

I claim:

1. A container for surface coating materials which can be stacked in rows at a point of sale comprising a container having an open flat top and provided with a carrying handle pivotally mounted at the open top of the container substantially offcenter with respect to a vertical center plane of the container such that when a user holds the container suspended by the pivotally mounted handle the container tips away from the handle such that a major part of the open top of the container is unobstructed by the presence of the handle and the user's hand, wherein the container has at least one pair of opposite sides which are straight and mutually parallel and the handle extends between said sides, and wherein the container is made of plastic material and comprises a thinwalled lower container body part having a firmly secured thereto a separately formed plastic upper shroud part which forms an upward external continuation of the lower container body wall and which includes said flat open top suitable for stacking, said upper shroud comprising an opening to receive a circular lid for the container, a pouring channel which is uppermost on the container when the container tips during suspension by the handle, and a recess to accommodate the handle entirely within the confines of the shroud part.

2. A container as claimed in claim 1 in which the lower body part is translucent and the shroud part is pigmented.

3. A container as claimed in claim 1 wherein said recess to accommodate the handle is defined in an upper side of said shroud part short of said flat top termination.

4. A stackable container for surface coating materials which can be stacked in rows at a point of sale comprising a container having an open flat top and provided with a carrying handle pivotally mounted on the container adjacent the open top of the container for supporting the container and its contents, said pivotally mounted handle being mounted substantially off-center with respect to a vertical center plane of the container such that when a user holds the container suspended by the handle the container tips away from the handle such that a major part of the open top of the container is unobstructed by the presence of the handle and the user's hand, wherein the container has at least one pair of opposite sides which are straight and mutually parallel and the handle extends between said sides, and wherein the container is made of plastic material and comprises a thin-walled lower container body part having firmly secured thereto a separately formed plastic upper shroud part which is substantially flush with an outside surface of the lower container body part so as to form a substantially smooth upward external continuation of the lower container body part and which includes said flat open top of the container, said upper shroud comprising an opening to receive a circular lid for the container, a pouring channel which is uppermost on the container when the container tips during suspension by the handle, and a recess to accommodate the handle entirely within the confines of the laterally outermost and uppermost extents of the shroud part.

* * * * *